US006796099B1

(12) United States Patent
Georges et al.

(10) Patent No.: US 6,796,099 B1
(45) Date of Patent: Sep. 28, 2004

(54) STRAP TIE HOLDER

(75) Inventors: William D. Georges, Brentwood, CA (US); Stephen B. Lamson, Pleasanton, CA (US); William F. Leek, Carmel, CA (US); Gregory S. Powell, Paso Robles, CA (US)

(73) Assignee: Simpson Strong-Tie Company, Inc., Dublin, CA (US); .

( * ) Notice: Subject to any disclaimer, the term of this patent is extended or adjusted under 35 U.S.C. 154(b) by 0 days.

(21) Appl. No.: 09/698,382

(22) Filed: Oct. 27, 2000

(51) Int. Cl.[7] ..... E04B 1/38

(52) U.S. Cl. ..... 52/699; 52/295; 248/499; 248/500

(58) Field of Search ..... 52/223.13, 223.12, 52/713, 715, 292, 295, 285.1, 274; 248/499, 500, 505, 223.41, 224.51, 224.61; 24/614, 615; 403/409.1, 374.1, 384, 386; 429/698, 699

(56) References Cited

U.S. PATENT DOCUMENTS

| | | | | | |
|---|---|---|---|---|---|
| 688,230 | A | | 12/1901 | Isrig et al. | |
| 1,873,731 | A | | 8/1932 | Zingali | |
| 2,020,986 | A | | 11/1935 | Anoschenko | |
| 2,116,263 | A | | 5/1938 | Harbaugh | |
| 2,806,495 | A | | 9/1957 | Merkle et al. | |
| 3,998,026 | A | | 12/1976 | Allen | |
| 4,202,149 | A | | 5/1980 | Betrue, Sr. | |
| 4,234,174 | A | | 11/1980 | Cardono | |
| 4,253,649 | A | | 3/1981 | Hewson | |
| 4,404,781 | A | | 9/1983 | Gilb | |
| 4,413,456 | A | | 11/1983 | Gilb | |
| 4,570,403 | A | | 2/1986 | Dannemiller | |
| 4,665,672 | A | * | 5/1987 | Commins et al. | 52/295 |
| 4,739,598 | A | | 4/1988 | Jensen et al. | |
| 4,846,615 | A | | 7/1989 | Forsyth | |
| 4,858,412 | A | | 8/1989 | Kassem | |
| 4,924,648 | A | * | 5/1990 | Gilb et al. | 52/295 |
| 4,943,023 | A | | 7/1990 | Becker | |
| 5,048,999 | A | | 9/1991 | Wurl | |
| 5,150,553 | A | | 9/1992 | Commins et al. | |
| 5,337,534 | A | * | 8/1994 | Nasca | 52/745.21 |
| 5,390,455 | A | | 2/1995 | Antolini | |
| 5,407,182 | A | | 4/1995 | Hartley | |
| 5,467,569 | A | * | 11/1995 | Chiodo | 52/713 |
| 5,595,031 | A | | 1/1997 | Commins | |
| 5,670,076 | A | | 9/1997 | Leek | |
| 5,813,182 | A | | 9/1998 | Commins | |
| 5,836,132 | A | * | 11/1998 | Weathersby | 52/702 |
| 6,189,348 | B1 | * | 2/2001 | Huang | 24/615 |

OTHER PUBLICATIONS

Advanced Connector Systems, "AFS Form Shoe" AFS Form Shoe Pamphlet, Advanced Connector Systems (Phoenix Arizona), pp. 1–3 (1996).*

Advanced Connector Systems, "AFS Holdown Form Shoes" Advanced Connector Systems Catalog, (Arizona), p. 34 and cover page (1997).

Advanced Connector Systems, "AFS Form Shoe," AFS Form Shoe Pamphlet, Advanced Connector Systems (Phoenix, Arizona), p. 1–3, (1996).

Symons Corporation, "Concrete Forming System," Concrete Forming System Brochure, Symons Corporation (Des Plaines, Illinois), p. 1–24, (1994).

(List continued on next page.)

*Primary Examiner*—Gwendolyn Baxter
(74) *Attorney, Agent, or Firm*—Charles R. Cypher; James R. Cypher

(57) ABSTRACT

A strap connector is compressibly held to a support member by a holder which is connected to the support member by fasteners. The support member can be a formboard for containing a concrete foundation during pouring and setting, and the strap connector is a strap tie holdown.

15 Claims, 10 Drawing Sheets

OTHER PUBLICATIONS

Simpson Strong–Tie Company, Inc., "PAHD/MPAHD/HPAHD Holdowns," Catalog C–95H–1, Simpson Strong–Tie Company, Inc. (Pleasanton, Califormia), p. 18–19, (1994)

Simpson Strong–Tie Company, Inc., "MASB/MAS/MAB/-MA Mudsill Anchors," Catalog C–98, Simpson Strong–Tie Company, Inc. (Pleasanton, California), p. 9, (1997).

Simpson Strong–Tie Company, Inc., "MKP Monkey Paw Anchor Bolt Holders," Catalog C–98, Simpson Strong–Tie Company, Inc. (Pleasanton, California), p. 21, (1997).

* cited by examiner

STRAP TIE HOLDER

BACKGROUND

This invention relates to a connection securing a strap connector to a support member. In particular, the holder of the present invention is designed to quickly and inexpensively permit temporary connection of strap tie holdowns to formboards during the pouring of concrete foundations.

Earthquakes, hurricanes, tornadoes, and floods impose forces on a building that can cause structural failure. To counteract these forces, it has become common practice to strengthen or add ties between the structural members of a building in areas where such cataclysmic forces can occur.

One of the most critical connections that should be made is between the support walls of a building and its foundation. In such an application, the connector or anchoring member embedded in the concrete foundation will often be placed near the side surface of the foundation. This is because the support walls of buildings are often built at the edges of the foundation. When an embedded anchor or connector is located near the side surface of a foundation, it is important that the concrete form a continuous member between the connector and the side surface to protect the connector from the elements and to maximize the concrete's hold on the embedded connector. Strap tie holdown connectors are designed to run along the outside of the shear wall, rather than through it as connectors that use anchor bolts do. Because shear walls are generally located with their outer side surface generally in line with the outer side surface of the stem wall foundation, the strap tie holdown connector, ideally, should protrude from the foundation at the interface of the outer side surface and upper surface of the foundation.

All holdowns must be suspended in place before the concrete foundations in which they are to be embedded are poured, but in the case of strap tie holdowns it is especially critical that the placement be as accurate as possible. In the prior art, strap tie holdowns have simply been nailed to the formboards. Alternatively, devices have been clipped to the formboard that allow fasteners to be -passed through both the device and the strap tie holdown, thereby hanging the strap tie holdown in place. Such devices are however limited by congruence of openings in the device and in the strap tie holdown.

SUMMARY OF THE INVENTION

An object of the present invention is to provide an improved means of holding strap connectors and temporarily connecting them to support members, particularly for holding strap tie holdowns and temporarily connecting them to formboards during the pouring of concrete foundations.

A benefit of the present invention is that it can provide an adjustable connection for holding strap connectors, allowing selected strap connectors to be held in a variety of positions along their length.

A benefit of the present invention is that the strap tie connector can be, but need not be directly nailed to the formboard.

A further benefit of the present invention is that the strap tie connector can be attached to the formboard by a holder that lies above the level of the cement foundation, such that the cementitious member is less disturbed.

DETAILED DESCRIPTION OF THE PREFERRED EMBODIMENTS

Figure 7:
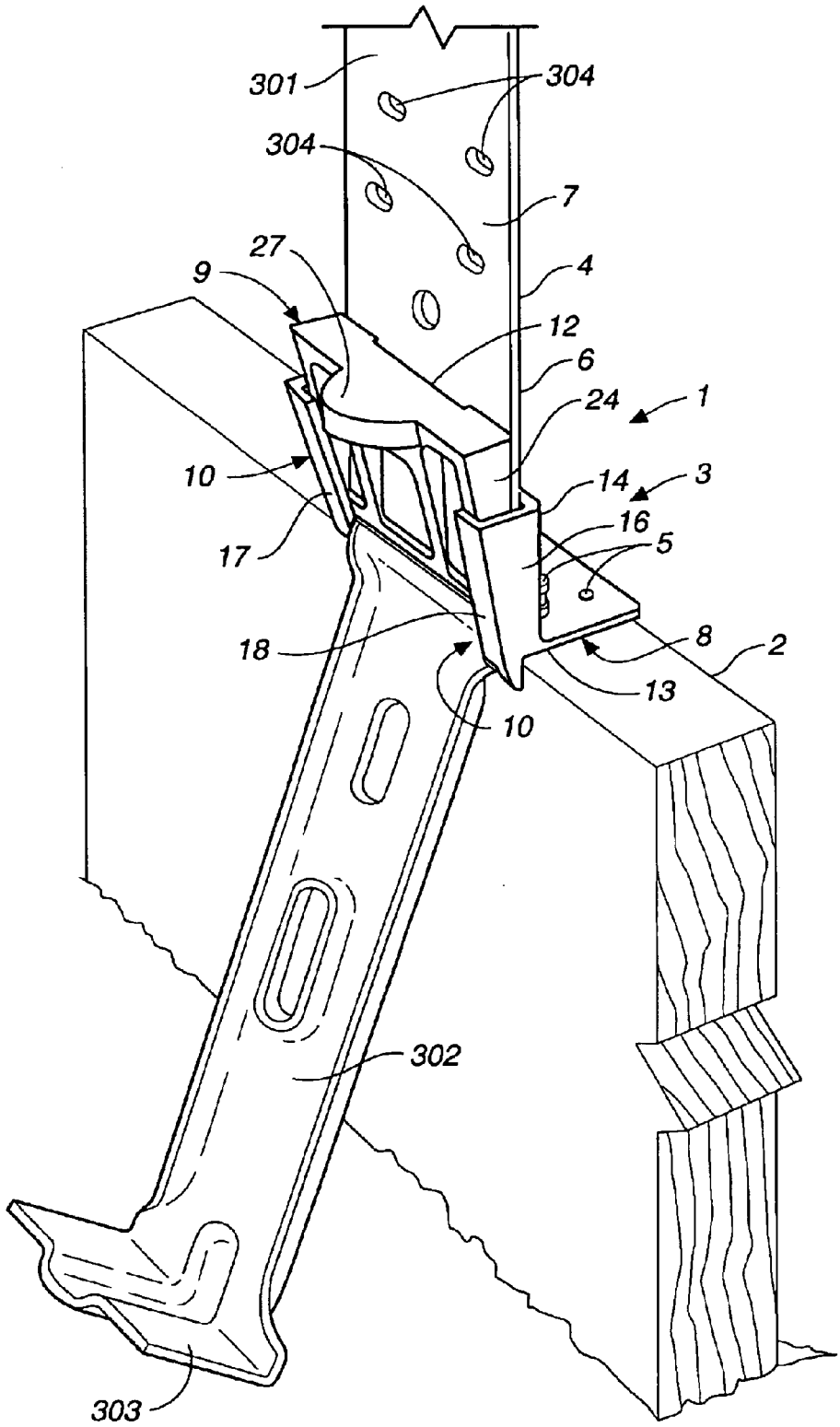
FIG. 7 is a perspective view of a preferred embodiment of the connection of the present invention showing the preferred embodiment of the holder of the present invention shown in FIG. 1.
Figure 8:
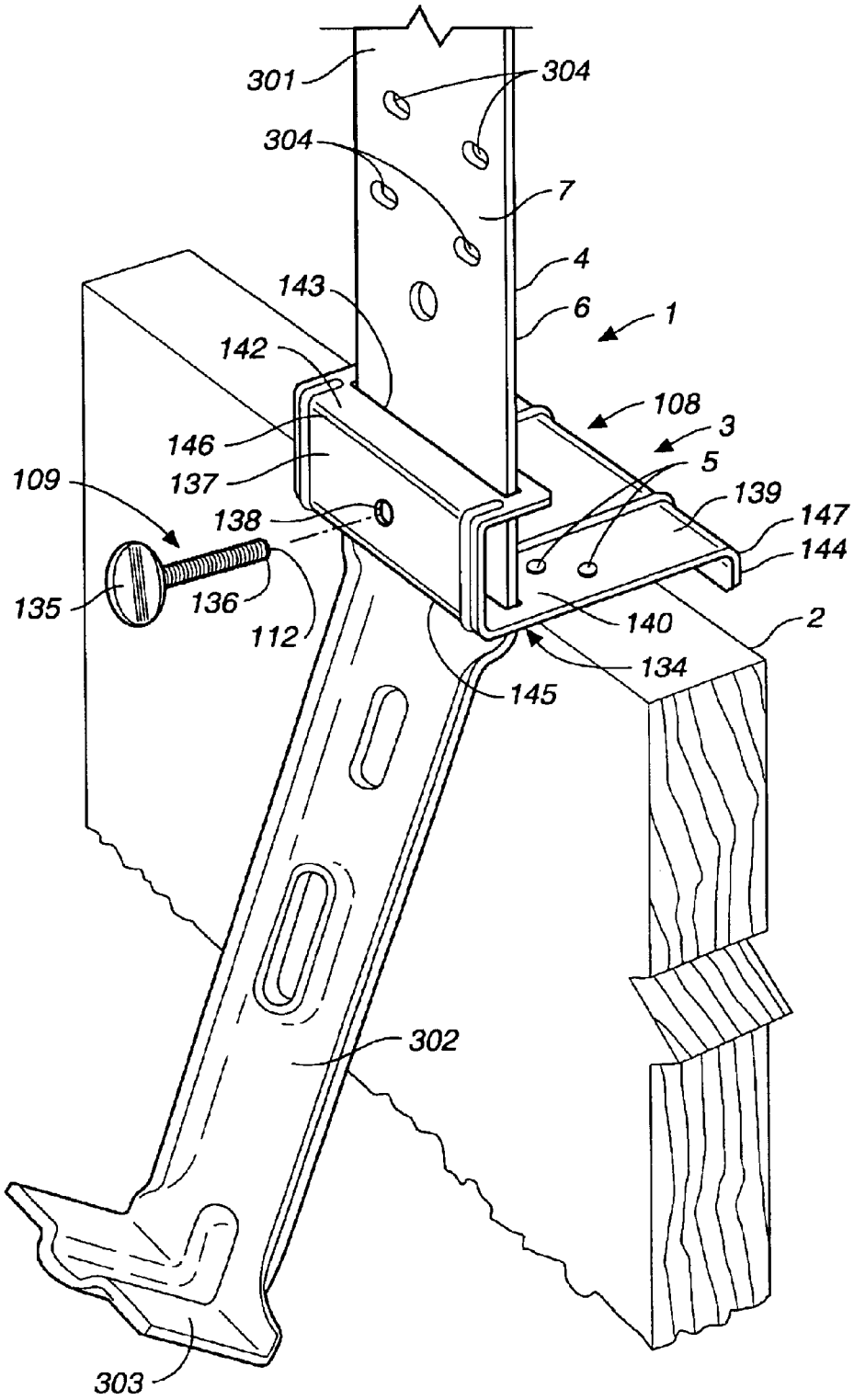
FIG. 8 is a perspective view of an alternate preferred embodiment of the connection of the present invention.
Figure 10:
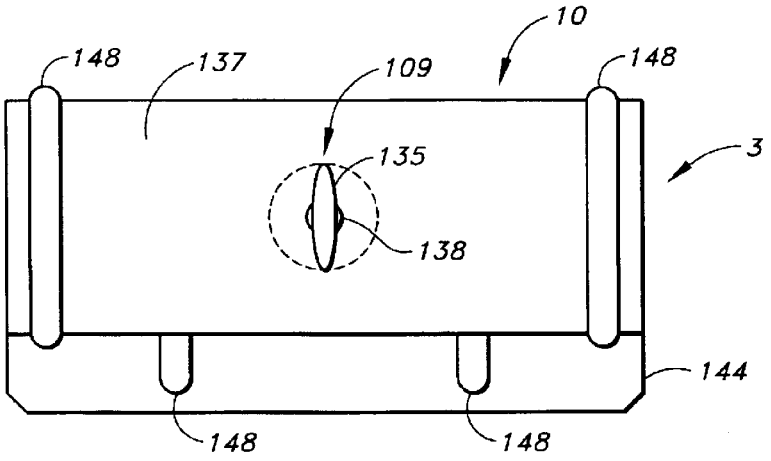
FIG. 10 is a front elevation view of the alternate preferred embodiment of the holder of the present invention shown in FIG. 8.
Figure 11:
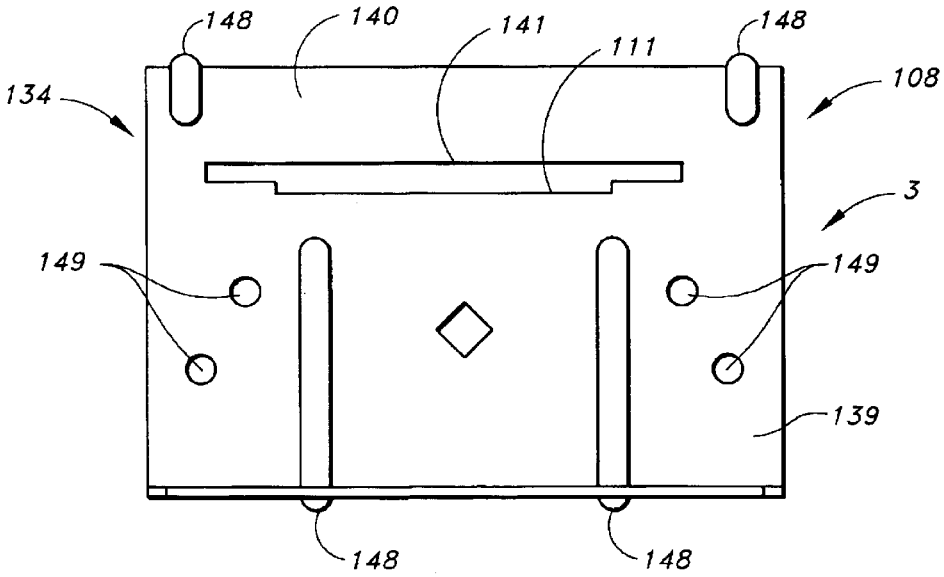
FIG. 11 is a bottom plan view of the alternate preferred embodiment of the holder of the present invention shown in FIG. 8.
Figure 12:
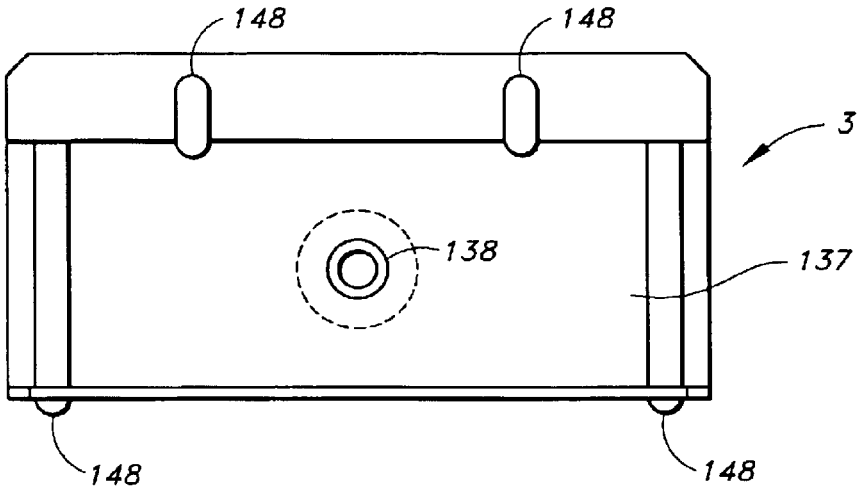
FIG. 12 is a back elevation view of the alternate preferred embodiment of the holder of the present invention shown in FIG. 8.
Figure 13:
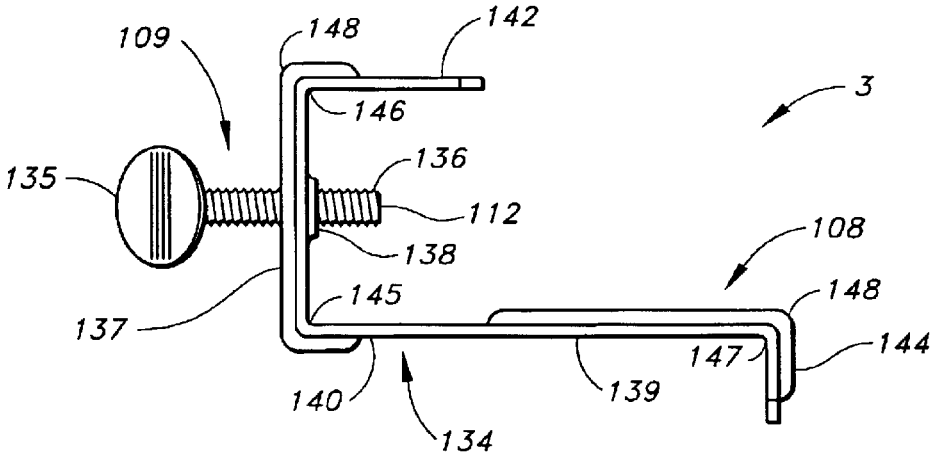
FIG. 13 is a side elevation view of the alternate preferred embodiment of the holder of the present invention shown in FIG. 8.

As seen in FIG. 7 and FIG. 8, the present invention is a connection 1 comprising a support member 2, a holder 3 for compressibly holding a strap connector 4, a strap connector 4 compressibly held by the holder 3, and fastener means 5 attaching the holder 3 to the support member 2.

The form of the holder 3 shown in FIG. 7 is preferably formed from a molded polymer. The form of the holder 3 shown in FIG. 8 is preferably formed from cut, punched, bent and embossed sheet metal.

Strap tie holdowns 4 are anchors that are partially embedded in a cementitious member. Strap tie holdowns 4 generally consist of a flat elongated upper section 301 connected to an embedment section 302. They are preferably made from sheet metal which is punched and formed to create the strap connection. The embedment section 302 is usually formed with a hook 303 at its end, and the embedment section 302 lies at an angle to the upper section 301. In a typical connection 1, the upper section 301 of the strap tie holdown 4 is preferably formed with openings 304 that receive fasteners such as nails or screws that connect the strap tie holdown 4 to a vertically disposed framing member.

In a preferred form of the present invention the support member 2 is a formboard for containing a concrete foundation during pouring and setting and the strap connector 4 is a strap tie holdown. Formboards can take many shapes and be made from many different materials.

Preferably, the strap connector 4 has a first face 6 and a second face 7, and the holder 3 comprises an attachment portion 8, compression means 9 and retaining means 10 for retaining the compression means 9 to the attachment portion 8.

Preferably, the first face 6 and the second face 7 are opposed side faces. Preferably, faces 6 and 7 are the broader faces of the strap connector 4, and the openings 304 are made in these faces 6 and 7.

In a preferred form of the present invention, the attachment portion 8 of the holder 3 has a first surface 11 that interfaces with the first face 6 of the strap connector 4 and the compression means 9 of the holder 3 has a second surface 12 that interfaces with the second face 7 of the strap connector 4, compressibly holding the strap connector 4.

As seen in FIG. 7, the attachment portion 8 of the holder 3 preferably further comprises a first portion 13 for attaching the holder 3 to the support member 2 in combination with fastener means 5, and a second portion 14 joined to the first portion 13 wherein the first surface 11 of the attachment portion 8 is located on the second portion 14.

Figure 1:
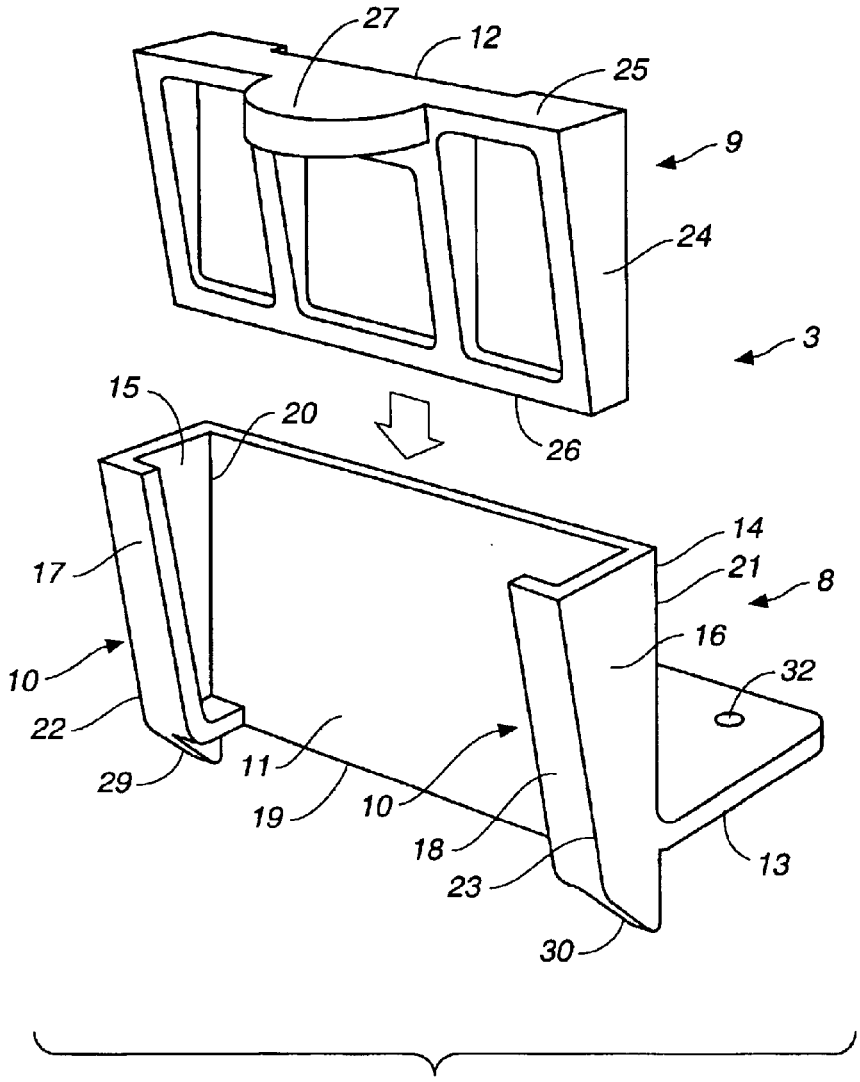
FIG. 1 is a perspective view of a preferred embodiment of the holder of the present invention.
Figure 2:
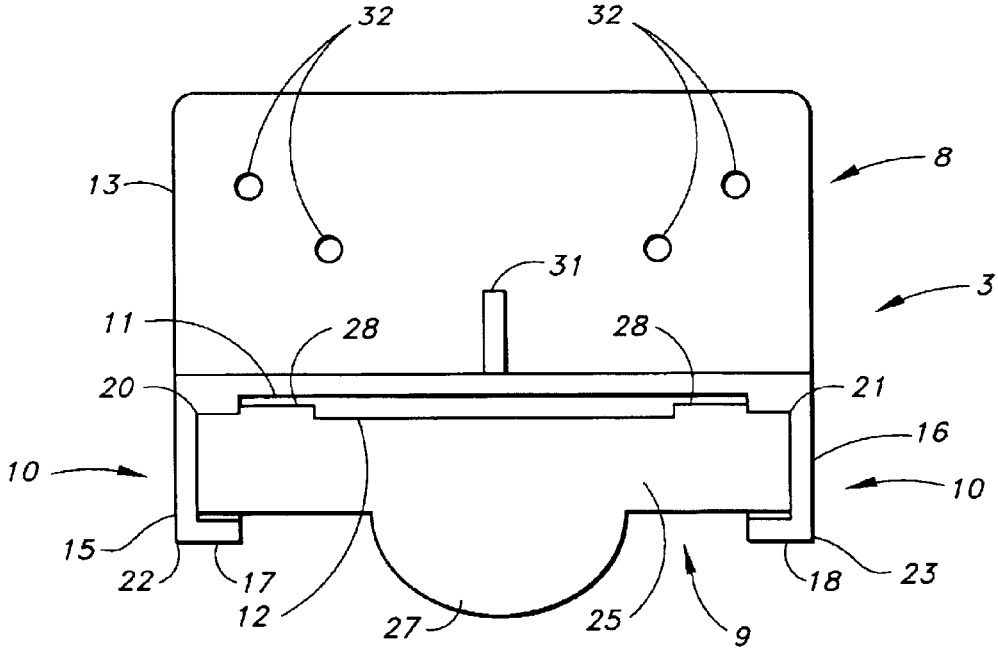
FIG. 2 is a top plan view of the preferred embodiment of the holder of the present invention shown in FIG. 1.
Figure 4:
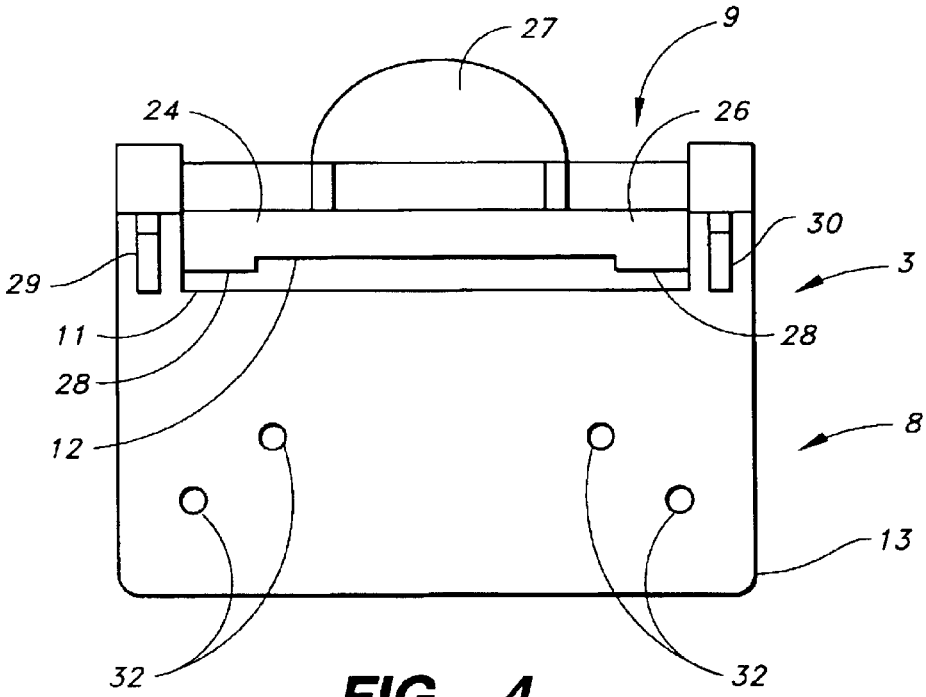
FIG. 4 is a bottom plan view of the preferred embodiment of the holder of the present invention shown in FIG. 1.
Figure 3:
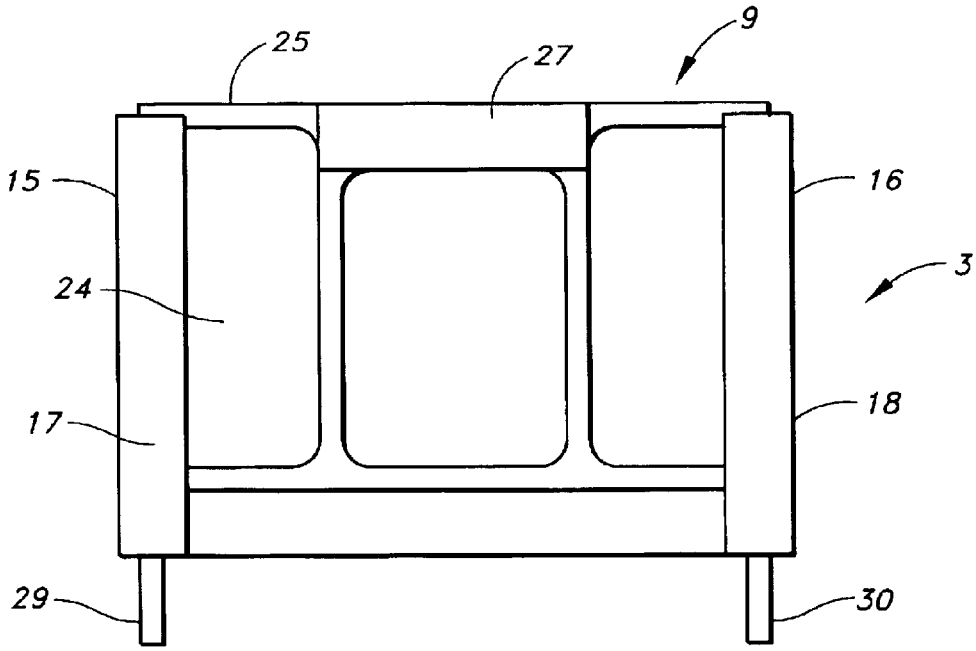
FIG. 3 is a front elevation view of the preferred embodiment of the holder of the present invention shown in FIG. 1.
Figure 6:
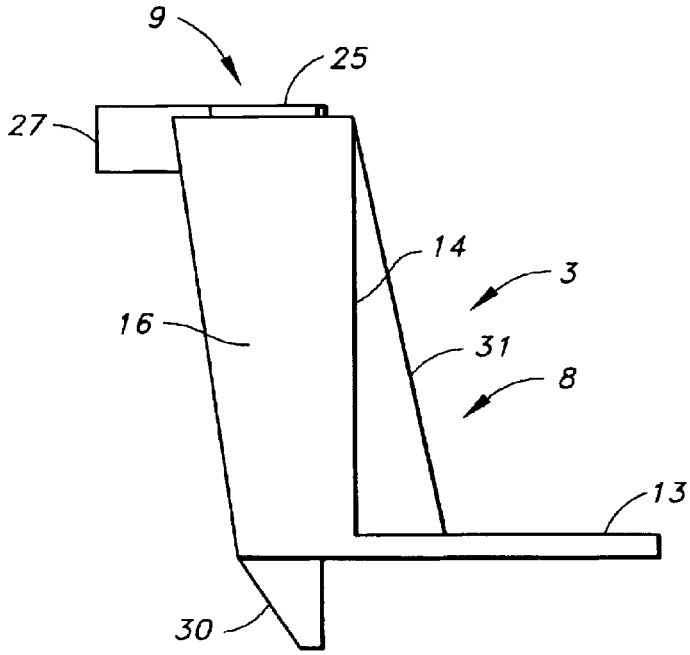
FIG. 6 is a side elevation view of the preferred embodiment of the holder of the present invention shown in FIG. 1.
Figure 5:
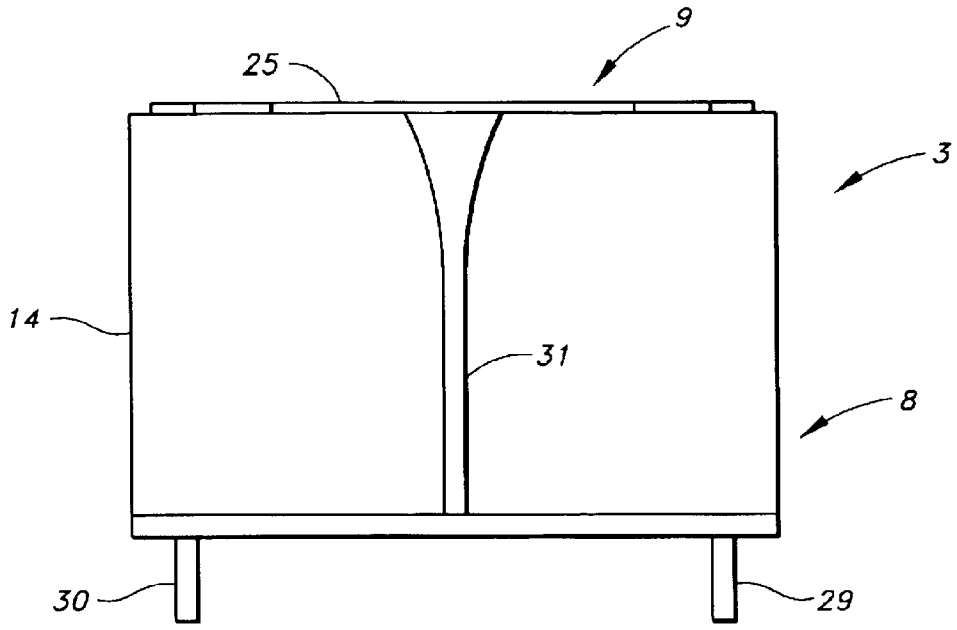
FIG. 5 is a back elevation view of the preferred embodiment of the holder of the present invention shown in FIG. 1.
Figure 9:
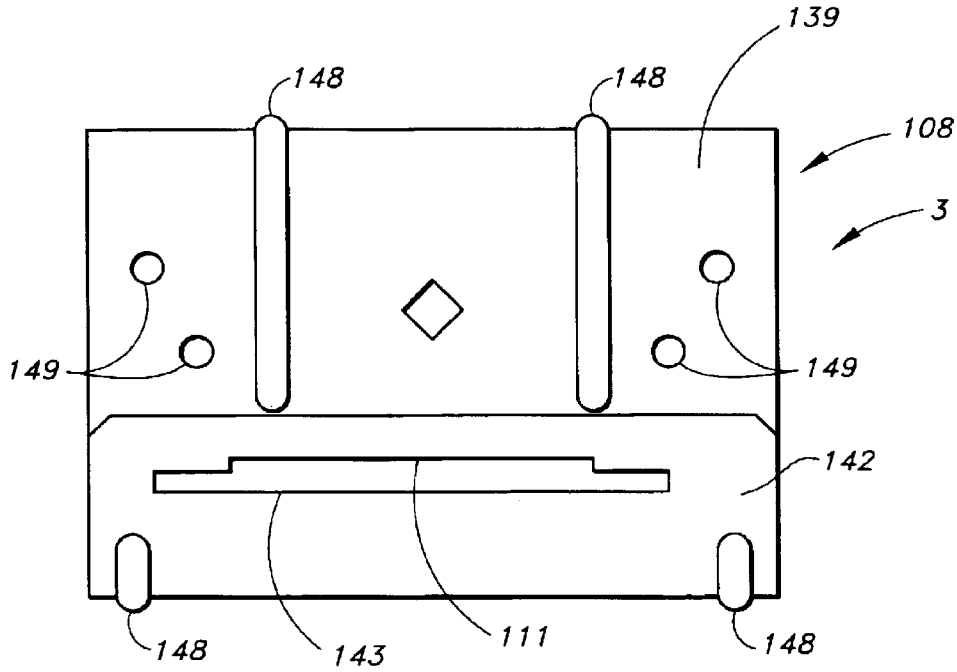
FIG. 9 is a top plan view of the alternate preferred embodiment of the holder of the present invention shown in FIG. 8.

As best seen in FIG. 1, the retaining means of the holder 3 preferably further comprises a third flange 15 joined to the second portion 14, a fourth flange 16 joined to the second portion 14, a fifth flange 17 joined to the third flange 15, a sixth flange 18 joined to the fourth flange 16. Although the fifth flange 17 and the sixth flange 18 are preferably separate, they can converge to create a four-sided sleeve with an attachment portion 8.

Preferably, the fifth flange 17 and the second portion 14 converge toward each other, and the sixth flange 18 and the second portion 14 converge toward each other.

Preferably, the first portion 13 is a first flange and the second portion 14 is a second flange disposed substantially orthogonally to the first flange 13, the third flange 15 is disposed substantially orthogonally to the second flange 14, the fourth flange 16 is disposed substantially orthogonally to the second flange 14, the fifth flange 17 is disposed substantially orthogonally to the third flange 15, and the sixth flange 18 is disposed substantially orthogonally to the fourth flange 16.

Preferably, the second flange 14 is joined to the first flange 13 at a first linear juncture 19, the third flange 15 is joined to the second flange 14 at a second linear juncture 20, the fourth flange 16 is joined to the second flange 14 at a third linear juncture 21, the fifth flange 17 is joined to the third flange 15 at a fourth linear juncture 22, and the sixth flange 18 is joined to the fourth flange 16 at a fifth linear juncture 23.

In the preferred form of the present invention, the fourth linear juncture 22 and the second linear juncture 20 converge toward the first linear juncture 19, and the fifth linear juncture 23 and the third linear juncture 21 converge toward the first linear juncture 19.

Preferably, the compression means 9 of the holder 3 is a wedge dimensioned to closely fit within the space defined by the second, third, fourth, fifth and sixth linear flanges 11, 15, 16, 17 and 18.

Preferably, the wedge further comprises a tapered portion 24 having a broad end 25 and a narrow end 26 and a tab 27 joined to the tapered portion 24 at the broad end 25.

Preferably, the tapered portion 24 of the wedge 9 further comprises a pair of raised guides 28 on the second surface 12 that closely fit the strap connector 4, and the attachment portion 8 of the holder 3 further comprises a first reference tab 29 and a second reference tab 30. Reference tabs 29 and 30 align the first surface 11 of the holder 3 with the edge of the support member 2, so that the strap connector will be aligned with the edge of the support member 2. If the present invention is formed from a molded polymer, or similarly plastic material, the wedge 9 may be hollowed out in order to save material and, therefor, cost and weight.

Preferably, the attachment portion 8 of the holder 3 further comprises a planar gusset 31 that is perpendicular to and connects the first flange 13 and the second flange 14.

Preferably, the first flange 13 of the attachment portion 8 further comprises fastener openings 32, and the fastener means 5 are fasteners. Fastener means 5 can also be a bracket, clip or clamp that interfaces with the support member 2. In the most preferred form of the invention, the fasteners 5 are 2 8*d* duplex nails, the duplex head allowing for easy removal, but the fasteners 5 may be nails, screws or tacks.

The connection 1 of the present invention is preferably made with this preferred embodiment by fixing the holder 3 to the support member 2, setting the first face 6 of the strap connector 4 against the first surface 11 of the holder 3 at the proper elevation, and inserting the compression means 9 or wedge into the retaining means 10 and pushing downwardly on the compression means 9 until the compression means 9 in conjunction with the retaining means 10 and the attachment portion compressibly hold the strap connector 4. The foundation 300 is then poured, the foundation 300 sets, the compression means 9 is removed, and the holder 3 is unfixed from the support member 2. Vertical framing members are then erected and the strap connector 4 is attached to one of the vertical framing members by typical fasteners such as nails.

In an alternate preferred embodiment of the present invention, the holder 3 further comprises a transition portion 134 connected to said attachment portion 108 having a first surface 111 that interfaces with the first face 6 of the strap connector 4, the compression means 109 of the holder 3 has a second surface 112 that interfaces with the second face 7 of the strap connector 4, compressibly holding the strap connector 4 and the compression means 109 is a screw with a proximal end 135 and a distal end 136 and the second surface 112 being at the distal end 136, and the retaining means is a retaining portion 137 attached to the transition portion 134, the retaining portion 137 having a threaded opening 138 that threadably receives the screw 109. Preferably, the screw 109 is a thumb screw that can be screwed and unscrewed without tools.

Preferably, the attachment portion 108 further comprises a fastener portion 139 fixing the holder 3 to the support member 2 in combination with fastener means 5. Preferably, the transition portion 134 further comprises a first strap receiving portion 140 with a first slot 141 closely dimensioned to receive the strap connector 4, the first surface 111 being a side of the first slot 141, and a second strap receiving portion 142, with a second slot 143 closely dimensioned to receive the strap connector 4, the first surface 111 being in line with a side of the second slot 143.

Preferably, the holder 3 further comprises a fourth flange 144 joined to the fastener portion 139.

Preferably, the retaining portion 137 is a second flange disposed substantially orthogonally to the first strap receiving portion 140, the second strap receiving portion 142 is a third flange disposed substantially orthogonally to the second flange 137, and the fourth flange 144 is disposed substantially orthogonally to the fastener portion 139.

Preferably, the second flange 137 is joined to the first strap receiving portion 140 at a first linear juncture 145, the first strap receiving portion 140 is an extension of the attachment portion 108, the third flange 142 is joined to the second flange 137 at a second linear juncture 146, and the fourth flange 144 is joined to the fastener portion 139 at a third linear juncture 147.

Preferably, the first linear juncture 145, the second linear juncture 146 and the third linear juncture 147 are reinforced with raised embossments 148, the fastener portion 139 further comprises fastener openings 149, and the fastener means 5 are fasteners. In the most preferred form of the invention, the fasteners 5 are 2 8*d* duplex nails, the duplex head allowing for easy removal, but the fasteners 5 may be nails, screws or tacks.

The connection 1 of the present invention is preferably made with this alternate preferred embodiment by fixing the holder 3 to the support member 2, sliding the strap connector 4 through the first slot 141 and the second slot 143 until the strap connector 4 is correctly positioned, and turning the a thumb screw 109 to compressibly hold the strap connector 4. The foundation 300 is then poured, the foundation 300 sets, the thumb screw 109 is unscrewed, the holder 3 is unfixed from the support member 2, the holder 3 is slid off of the strap connector 4, vertical framing members are then erected and the strap connector 4 is attached to one of the vertical framing members.

Figure 14:
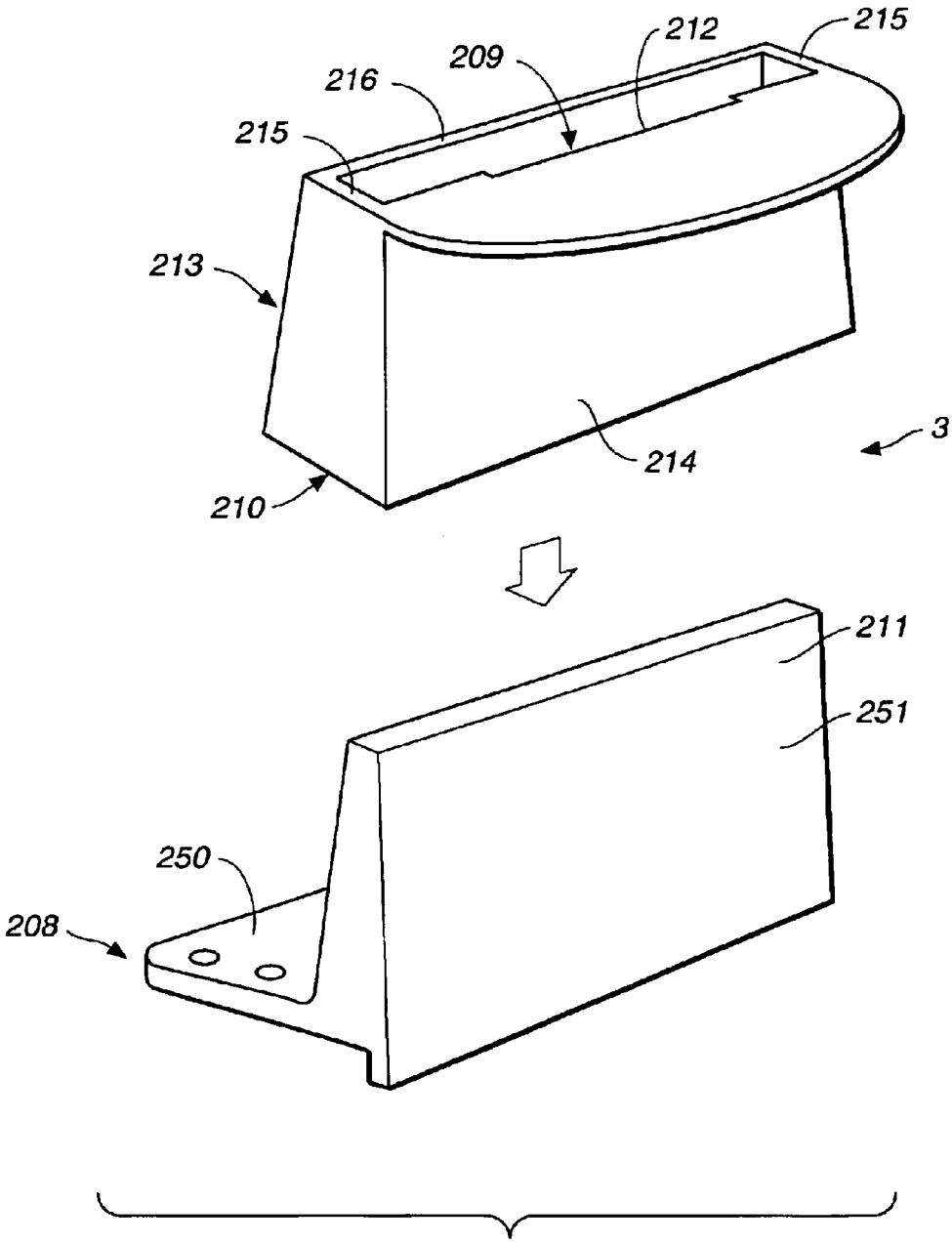
FIG. 14 is a perspective view of another alternate preferred embodiment of the holder of the present invention.
Figure 15:
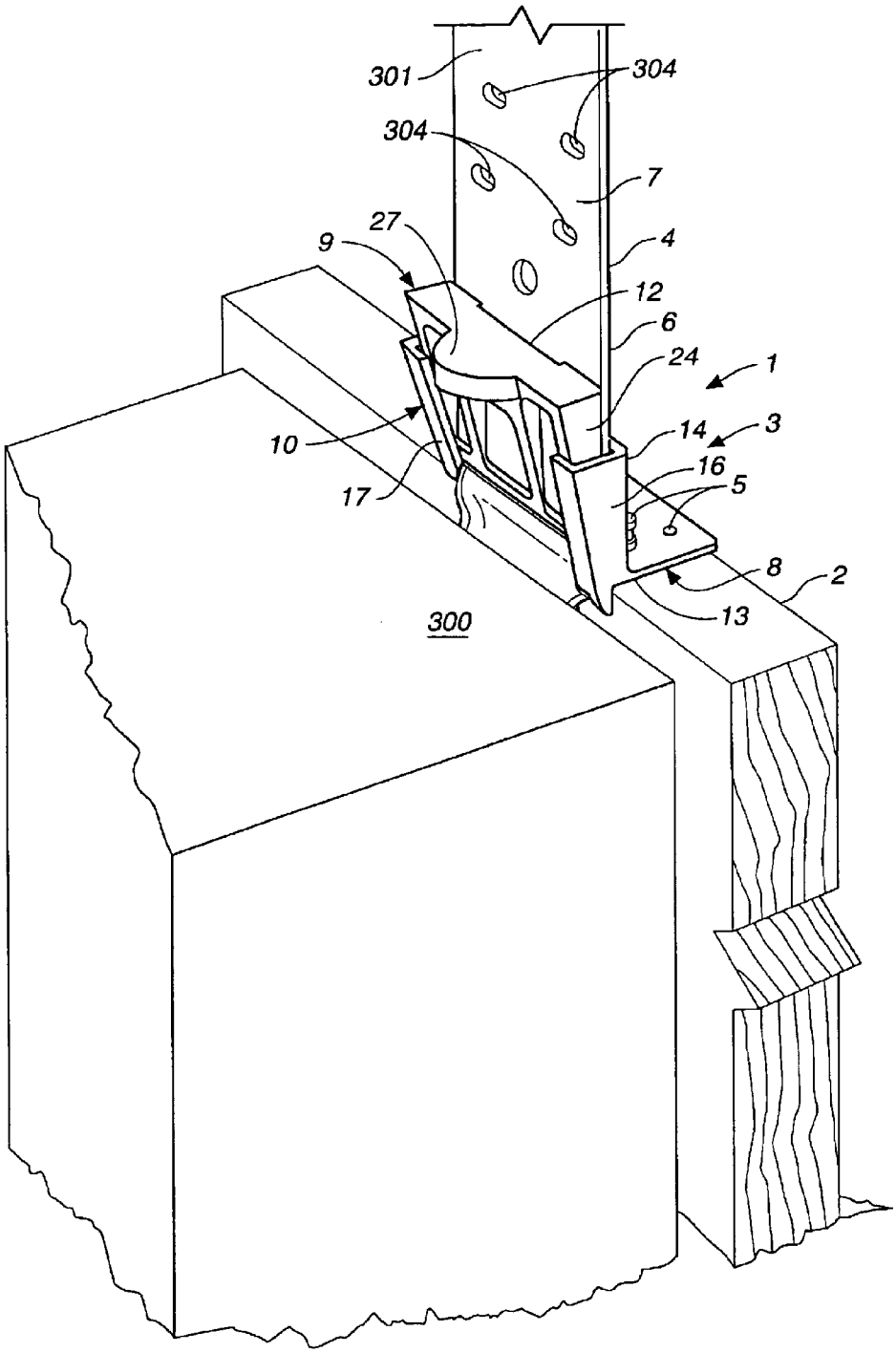
FIG. 15 is a perspective view of a preferred embodiment of the connection of the present invention showing the preferred embodiment of the holder of the present invention shown in FIG. 1.

As shown in FIG. 14, in another alternate preferred embodiment of the present invention, the attachment portion 208 further comprises a first portion 250 for attaching the holder 3 to the support member 2 in combination with fastener means 5, and a wedge 251 having a first surface 211, the wedge 251 being joined to the first portion 250. Preferably, the compression means 209 is part of a sleeve 213. The compression means 209 is a first wall 214 of the sleeve 213. The first wall 214 has a second surface 212 closely dimensioned to fit the wedge 251 such that the strap connector 4 passes through the sleeve 213 and is compressed between the first surface 211 of the wedge 251 and the second face 212 of the sleeve 213. The retaining means 210 are incorporated in the sleeve 213 as side walls 215 and an opposed wall 216 from the first wall 214, all in connection to the first wall 214. In this preferred embodiment, the retaining means 210 and the compression means are incorporated in a sleeve 213 with the four walls shown; however, either the first wall 214 or the opposed wall 216 could be discontinuous and consist of two separated flanges joined to the side walls 215.

The connection 1 of the present invention is preferably made with this alternate preferred embodiment by fixing the holder 3 to the support member 2, sliding the sleeve 213 over the strap connector 4, positioning the strap connector 4, and sliding the sleeve 209 over the wedge 251 to compressibly hold the strap connector 4. The foundation 300 is then poured, the foundation 300 sets, the sleeve 213 is released, the holder 3 is unfixed from the support member 2, vertical framing members are then erected and the strap connector 4 is attached to one of the vertical framing members.

Although the connection formed in accordance with the present invention has been described in detail, the above description is not intended to limit the scope of this invention except as stated in the claims.

We claim:

1. A connection comprising:

a. a support member, said support member being a formboard for containing concrete:

b. a holder for compressibly holding a strap connector without penetration, said holder having an attachment portion, compression means and retaining means for retaining said compression means to said attachment portion;

c. a strap connector compressibly held by said holder without penetration of said strap connector by said holder, said strap connector having a first face and a second face and said strap connector is a strap tie holdown; and d. a fastener means attaching said holder to said support member; wherein e. said attachment portion of said holder has a first surface that interfaces with said first face of said strap connector and said compression means of said holder has a second surface that interfaces with said second face of said strap connector, compressibly holding said strap connector;

f. said attachment portion of said holder further comprises a first portion for attaching said holder to said support member in combination with said fastener means and a second portion joined to said first portion wherein said first surface of said attachment portion is located on said second portion; and wherein g. said first portion is a first flange and said second portion is a second flange disposed substantially orthogonally to said first flange and said retaining means of said holder further comprises:

i. a third flange joined to said second portion;

ii. a fourth flange joined to said second portion;

iii. a fifth flange joined to said third flange;

iv. a sixth flange joined to said fourth flange.

2. The connection of claim 1 wherein:

a. said fifth flange and said first surface converge toward each other; and b. said sixth flange and said first surface converge toward each other.

3. The connection of claim 2 wherein:

a. said third flange is disposed substantially orthogonally to said second flange;

b. said fourth flange is disposed substantially orthogonally to said second flange;

c. said fifth flange is disposed substantially orthogonally to said third flange; and d. said sixth flange is disposed substantially orthogonally to said fourth flange.

4. The connection of claim 3 wherein:

a. said second flange is joined to said first flange at a first linear juncture;

b. said third flange is joined to said second flange at a second linear juncture;

c. said fourth flange is joined to said second flange at a third linear juncture;

d. said fifth flange is joined to said third flange at a fourth linear juncture; and e. said sixth flange is joined to said fourth flange at a fifth linear juncture.

5. The connection of claim 4 wherein said compression means of said holder is a wedge dimensioned to closely fit within the space defined by said second, third, fourth, fifth and sixth flanges.

6. The connection of claim 5 wherein said wedge further comprises:

a tapered portion having a broad end and a narrow end and a tab joined to said tapered portion at said broad end.

7. The connection of claim 6 wherein:

a. said tapered portion of said wedge further comprises a pair of raised guides on said second surface that closely fit said strap connector; and b. said attachment portion of said holder further comprises a first reference tab and a second reference tab.

8. The connection of claim 7 wherein said attachment portion of said holder further comprises a planar gusset that is perpendicular to and connects said first flange and said second flange.

9. The connection of claim 8 wherein:

a. said first flange of said attachment portion further comprises fastener openings; and b. said fastener means are fasteners.

10. A connection comprising:

a. a support member, said support member being a formboard for containing concrete;

b. a holder for compressibly holding a strap connector without penetration and wherein said holder comprises an attachment portion, compression means and retaining means for retaining said compression means to said attachment portion;

c. a strap connector compressible held by said holder without penetration of said strap connector by said holder, said strap connector being a strap tie holdown and said strap connector has a first face and a second face; and d. a fastener means attaching said holder to said support member, wherein:

e. said holder further comprises a transition portion connected to said attachment portion having a first surface that interfaces with said first face of said strap connector;

f. said compression means of said holder has a second surface that interfaces with said second face of said strap connector, compressibly holding said strap connector and said compression means is a screw with a proximal end and a distal end and said second surface being at said distal end;

g. said retaining means is a retaining portion attached to said transition portion, said retaining portion having a threaded opening that threadably receives said screw;

h. a said attachment portion further comprises a fastener portion fixing said holder to said support member in combination with said fastener means, said first portion is a first flange i. said transition portion further comprises:

i. a first strap receiving portion with a first slot closely dimensioned to receive said strap connector, said first surface being a side of said first slot; and ii. a second strap receiving portion, with a second slot closely dimensioned to receive said strap connector, said first surface being in line with a side of said second slot.

11. The connection of claim 10, wherein said holder further comprises a fourth flange joined to said fastener portion.

12. The connection of claim 11, wherein:

a. said retaining portion is a second flange disposed substantially orthogonally to said first strap receiving portion;

b. said second strap receiving portion is a third flange disposed substantially orthogonally to said second flange; and c. said fourth flange is disposed substantially orthogonally to said fastener portion.

13. The connection of claim 12, wherein:

a. said second flange is joined to said first strap receiving portion at a first linear juncture;

b. said third flange is joined to said second flange at a second linear juncture; and c. said fourth flange is joined to said fastener portion at a third linear juncture.

14. The connection of claim 13, wherein:

a. said first linear juncture, said second linear juncture and said third linear juncture are reinforced with raised embossments;

b. said fastener portion further comprises fastener openings; and c. said fastener means are fasteners.

15. A connection comprising:

a. a support member, said support member being a formboard for containing concrete;

b. a holder for compressibly holding a strap connector without penetration and wherein said holder comprises an attachment portion, compression means and retaining means for retaining said compression means to said attachment portion;

c. a strap connector compressibly held by said holder without penetration of said strap connector by said holder, said strap connector being a strap tie holdown and said strap connector has a first face and a second face; and d. a fastener means attaching said holder to said support member, wherein:

e. said attachment portion further comprises:

i. a first portion for attaching said holder to said support member in combination with fastener means; and ii. a wedge having a first surface, said wedge being joined to said first portion; and f. said compression means is a sleeve having a second surface closely dimensioned to fit said wedge such that said strap connector passes through said sleeve and is compressed between said first surface of said wedge and said second surface of said sleeve, and said retaining means are incorporated in said compression means.

* * * * *

UNITED STATES PATENT AND TRADEMARK OFFICE

CERTIFICATE OF CORRECTION

PATENT NO. : 6,796,099 B1
DATED : September 28, 2004
INVENTOR(S) : William D. Georges et al.

It is certified that error appears in the above-identified patent and that said Letters Patent is hereby corrected as shown below:

Column 7,
Line 47, replace "h. a said attachment portion further comprises a fastener" with -- h. said attachment portion further comprises a fastener --.
Line 49, replace "combination with said fastener means, said first portion" with -- combination with fastener means; --.
Line 50, replace "is a first flange" with -- (leave blank) --.

Signed and Sealed this

Twelfth Day of April, 2005

JON W. DUDAS
*Director of the United States Patent and Trademark Office*